United States Patent [19]

DuBois et al.

[11] Patent Number: 4,720,334

[45] Date of Patent: Jan. 19, 1988

[54] DIAPHRAGM FOR ELECTROLYTIC CELL

[75] Inventors: Donald W. DuBois, Akron; William W. Carlin, Norton, both of Ohio

[73] Assignee: PPG Industries, Inc., Pittsburgh, Pa.

[21] Appl. No.: 926,495

[22] Filed: Nov. 4, 1986

[51] Int. Cl.[4] ..... C25B 13/00

[52] U.S. Cl. ..... 204/296; 427/244; 427/372.2; 427/393.5; 427/294; 427/295; 427/296; 252/352; 204/98; 204/128

[58] Field of Search ..... 204/296, 98, 128; 252/352; 427/244, 372.2, 393.5, 294–296

[56] References Cited

U.S. PATENT DOCUMENTS

| | | | |
|---|---|---|---|
| 4,003,818 | 1/1977 | Juillard | 204/295 |
| 4,036,729 | 7/1977 | Patil et al. | 204/296 |
| 4,125,451 | 11/1978 | Patil et al. | 204/296 |
| 4,138,314 | 2/1979 | Patil et al. | 162/102 |
| 4,154,666 | 5/1979 | Patil et al. | 204/283 |
| 4,170,539 | 10/1979 | Simmons | 204/295 |
| 4,210,515 | 7/1980 | Patil et al. | 204/266 |
| 4,238,303 | 12/1980 | Fang | 204/295 |
| 4,421,579 | 12/1983 | Covitch et al. | 204/295 |
| 4,432,860 | 2/1984 | Bachot et al. | 204/296 |
| 4,539,085 | 9/1985 | Bachot et al. | 204/98 |

*Primary Examiner*—R. L. Andrews

*Attorney, Agent, or Firm*—Edward J. Whitfield; Bruce H. Cottrell

[57] ABSTRACT

A liquid permeable diaphragm formed of a major amount polyfluorocarbon fibrils and a minor amount perfluorinated ion exchange material is disclosed. Optionally, the diaphragm may also include inorganic materials such as zirconium oxide, titanium dioxide, aluminum oxide, talc, barium sulfate or potassium titanate, or hydrous inorganic gels such as magnesium oxide gel, zirconium oxide gel, titanium oxide gel or zirconyl phosphate gel. The diaphragm can be prepared by depositing the polyfluorocarbon fibrils and the perfluorinated ion exchange material from a slurry, preferably an aqueous slurry. Optionally, a pore former such as, e.g., polypropylene can be codeposited from the slurry and subsequently removed by heat or dissolution to provide the desired permeability.

41 Claims, No Drawings

DIAPHRAGM FOR ELECTROLYTIC CELL

FIELD OF THE INVENTION

The present invention relates to diaphragms useful for the electrolysis of salt solutions, e.g., in the electrolysis of aqueous alkali metal halide solutions such as sodium chloride brine. More particularly, this invention relates to diaphragms which are formed by deposition from a slurry onto an electrode of an electrolytic cell.

BACKGROUND OF THE INVENTION

Commonly, alkali metal halide brines, such as sodium chloride brines and potassium chloride brines, are electrolyzed in an electrolytic cell wherein a liquid permeable diaphragm divides the cell into an anolyte compartment with an anode therein and a catholyte compartment with a cathode therein to produce chlorine, hydrogen, and aqueous alkali metal hydroxide. Asbestos has been the most common diaphragm material, but has suffered from relatively short lifetimes and from environmental concerns. Asbestos-free microporous diaphragms have been produced by sintering materials such as polytetrafluoroethylene (PTFE) and a particulate pore forming additive followed by subsequent removal of the additive, as shown by for example U.S. Pat. Nos. 3,930,979, 4,098,672 and 4,250,002. While such microporous diaphragms have a long service life, they have been produced in the form of sheets and are not easily utilized in electrolytic cells having complex nonplanar electrode geometries, such as diaphragm cells with fingered anodes and cathodes as shown in U.S. Pat. No. 3,910,827. Additionally, the temperatures required to sinter commercial size diaphragms of a material such as polytetrafluoroethylene result in a significant energy consumption.

U.S. Pat. No. 4,036,729 describes depositing discrete thermoplastic fibers of, e.g., a fluorinated hydrocarbon, from an aqueous medium containing acetone and preferably a fluorocarbon surfactant onto a cathode screen for use as a diaphragm in electrolytic cells. The deposited fibers form an entanglement or network which does not require bonding or cementing. Unfortunately, such polyfluorocarbon diaphragms generally are hydrophobic, i.e., difficult to wet with water. This hinders dispersion of the polyfluorocarbon fibers in an aqueous medium prior to deposition, hinders passage of an aqueous electrolyte through the diaphragm, and results in high cell voltages, particularly in comparison to asbestos-based diaphragms under similar cell conditions.

U.S. Pat. No. 4,482,441 describes codeposition of fibrils of a hydrophobic organic polymer, e.g., a copolymer of tetrafluoroethylene and perfluoropropylene, and a hydrophilic group IIA metallic oxide, e.g., magnesium oxide particles, from an alkaline brine containing sodium hydroxide, sodium chloride and a polyethyleneimine-based retention agent onto the cathode of a cell. Such a deposited diaphragm may also include a surface active agent, e.g., a fluorinated surface active agent.

U.S. Pat. No. 4,170,539 describes a diaphragm having a porous, hydrophobic fluorocarbon matrix, an intermediate layer or film of a hydrophilic fluorocarbon resin, e.g., a perfluorinated polymer having pendant ion exchange groups, on the surfaces of the matrix, a hydrous oxide of zirconium and optionally a hydrous oxide of magnesium, the hydrous oxides contained within the pores of the matrix. The intermediate layer of hydrophilic resin is applied onto pre-formed hydrophobic matrix.

Finally, U.S. Pat. No. 4,606,805 describes a diaphragm containing as its principal particulate ingredient an inorganic material such as talc, a metal silicate, an alkali metal titanate, an alkali metal zirconate or a magnesium aluminate, along with both polytetrafluoroethylene fibers and polytetrafluoroethylene particulates. After deposition, such a diaphragm is sintered at temperatures of about 350° C.

It is desirable to have diaphragms, e.g., polyfluorocarbon-based diaphragms, prepared by depositing the diaphragm material onto the cathode of a cell, the deposition preferably being from an aqueous slurry.

SUMMARY OF THE INVENTION

It has now been found that diaphragms of fibrillated polyfluorocarbon, such as polytetrafluoroethylene, can achieve greatly improved performance in terms of cell voltages while exhibiting excellent wettability by aqueous electrolytes such that the permeability of the diaphragms compares favorably with the permeability of asbestos-based diaphragms.

The invention herein contemplated provides liquid permeable diaphragms for electrolytic cells. The diaphragms are depositable from a slurry medium directly onto an electrode, e.g., a foraminous cathode, having a nonplanar configuration. In one embodiment of this invention, the diaphragm includes from about 65 to 99 percent by weight fibrillated polyfluorocarbon and from about 1 to about 35 percent by weight perfluorinated ion exchange material, basis total weight of polyfluorocarbon and perfluorinated ion exchange material. Preferably, the polyfluorocarbon is polytetrafluoroethylene and the perfluorinated ion exchange material is a perfluorinated organic polymer containing ion exchange functional groups selected from the group consisting of carboxylic acid (—COOH), sulfonic acid (—$SO_3H$) or an alkali metal salt of carboxylic acid or sulfonic acid. The perfluorinated ion exchange material can be present in the form of particulates usually dispersed throughout the diaphragm or as a film coating the fibrillated polyfluorocarbon.

In another embodiment, the diaphragm of fibrillated polyfluorocarbon and perfluorinated ion exchange material also includes a minor amount of inorganic particulates chemically resistant to the intended cell environment, such particulates exemplified by titanium dioxide, zirconium oxide, potassium titanate, silicon carbide, aluminum oxide, talc, barium sulfate, asbestos, and mixtures thereof. Again, the perfluorinated ion exchange material can be present in the form of particulates or as a film coating either or both of the fibrillated polyfluorocarbon and the chemically resistant inorganic particulates.

In yet another embodiment of the invention, the diaphragm, i.e., either the diaphragm of fibrillated polyfluorocarbon and perfluorinated ion exchange material or the diaphragm further including a minor amount of the chemically resistant inorganic particulates, is codeposited with a pore forming material such as cellulose, polypropylene, calcium carbonate, rayon, polyethylene, nylon or starch, thereby allowing the porosity and liquid permeability of such a diaphragm to be increased by removal of pore forming material.

In still another embodiment, the diaphragm containing the fibrillated polyfluorocarbon, the perfluorinated ion exchange material, and optionally either or both of the chemically resistant inorganic particulates and pore forming material, also includes an inorganic gel, e.g., a hydrous metal oxide gel such as a hydrous magnesium oxide gel, a hydrous zirconium oxide gel, a hydrous titanium dioxide gel and mixtures of such metal oxide gels, or a metal phosphate gel such as a zirconyl phosphate gel. By use of the inorganic gel, it is possible to reduce the liquid permeability of the diaphragms via plugging of diaphragm pores with such gel to provide uniform electrolyte flow and with certain of the gels impart ion exchange capabilities in addition to any such ion exchange capabilities provided by the perfluorinated ion exchange material. Also, use of the gels can overcome the disadvantages of an overly permeable diaphragm.

The liquid permeable, diaphragms of this invention are prepared by deposition of the polyfluorocarbon fibrils, the perfluorinated ion exchange material and optionally the chemically resistant inorganic particulates and pore forming material from a slurry, e.g., onto a foraminous cathode of an electrolytic cell. For example, in the preparation of the diaphragm including fibrillated polyfluorocarbon and perfluorinated ion exchange material, the slurry will be made up of a liquid medium, polyfluorocarbon fibrils and perfluorinated ion exchange material. The perfluorinated ion exchange material may be present as a suspension or dispersion of particulates or as a solution of such material. Preferably, the polyfluorocarbon fibrils and perfluorinated ion exchange material are deposited onto a foraminous cathode whereby to form a diaphragm mat, and the deposited diaphragm mat then heated at temperatures below the sintering or decomposition temperatures of both said polyfluorocarbon fibrils and said perfluorinated ion exchange material for a sufficient time to secure the diaphragm upon the cathode. Naturally, the extent of heating is such as not to impact adversely on the cathode or any electrocatalytic component thereof. In an embodiment wherein the deposited diaphragm further includes pore forming material whereby the porosity and liquid permeability of the diaphragm can be subsequently increased, the slurry will further include the pore forming material. The process thereafter includes codepositing the pore forming material upon the cathode with the other diaphragm materials, e.g., fibrillated polyfluorocarbon and perfluorinated ion exchange material.

In the diaphragm-forming process of this invention, the liquid medium is preferably water or aqueous solutions of an alkali metal chloride, an alkali metal hydroxide or mixtures thereof, e.g., an aqueous solution of sodium hydroxide. Such aqueous slurries will preferably include other materials such as either or both a surfactant and a viscosity modifier to assist in dispersing and suspending the diaphragm materials. For example, in one embodiment of the process, the aqueous slurry includes a preferred non-ionic surfactant of the formula $R—OR')_xCl$ wherein R is a $C_1$–$C_{30}$ linear or branched alkyl or mixtures of such alkyls, R' is an ethylene group, i.e., $—CH_2—CH(R'')—$, wherein R'' is hydrogen, methyl, ethyl or mixtures thereof, and x is a number from 5 to 15. More preferably, R is a $C_8$–$C_{15}$ linear or branched alkyl and x is 8 to 12. Most preferably, R is a mixture of $C_{12}$–$C_{15}$ alkyl, R' is ethylene and x is 8 or 9. The preferred non-ionic surfactant can provide improved wettability and dispersion of polyfluorocarbon particulates and particularly polytetrafluoroethylene particulates, e.g., fibrillated polytetrafluoroethylene, in aqueous mediums.

DETAILED DESCRIPTION OF THE INVENTION

In contrast to liquid impermeable, ion permeable membranes, the diaphragm separators of this invention are liquid permeable, thus allowing an electrolyte subjected to a pressure gradient to pass through the diaphragm. Typically, the pressure gradient in a diaphragm cell is the result of a hydrostatic head on the anolyte side of the cell, that is, the liquid level in the anolyte compartment will be on the order of from about 1 to about 25 inches higher than the liquid level of the catholyte, although higher or lower levels are permissable and restricted only by space or electrolytic cell hardware limitations. The specific flow rate of electrolyte through the diaphragm can vary with the type and use of the cell. In a chlor-alkali cell, the diaphragm should be able to pass about 0.001 to about 0.5 cubic centimeters of anolyte per minute per square centimeter of diaphragm surface area. The flow rate is generally set at a rate that allows a predetermined, targeted product concentration, e.g., sodium hydroxide concentration, and the level differential between the anolyte and catholyte compartments is then related to the porosity of the diaphragm and the tortuosity of the pores. For use in a chlor-alkali cell the diaphragm will preferably have a permeability similar to that of asbestos-type diaphragms so that electrolytic cell equipment in operation with asbestos-type diaphragms can be utilized.

In one embodiment, the diaphragm of this invention includes fibrillated polyfluorocarbon and perfluorinated ion exchange material wherein the diaphragm is prepared by depositing perfluorinated ion exchange material in the form of discrete particulates or as a solution, and polyfluorocarbon fibrils from a slurry onto a cathode, e.g., onto a cathode with a non-planar configuration. For example, polyfluorocarbon fibrils and discrete perfluorinated ion exchange material particulates can be dispersed within the liquid slurry without rapid settling. Surfactants and viscosity modifiers may be added to aid in the dispersion. Following deposition, a fibrillated polyfluorocarbon mat having a highly branched structure, which branched structure provides support for the diaphragm through entanglement of the fibrils, is formed. The polyfluorocarbon fibrils can be drawn against the cathode under the pressure of a vacuum to provide packing of the diaphragm material.

Inclusion of perfluorinated ion exchange material with the polyfluorocarbon fibrils provides the diaphragm with wettability, i.e., an aqueous brine can pass through the diaphragm without the necessity of first passing a liquid such as an alcohol through the diaphragm. Also, the diaphragm will not tend to accumulate gas bubbles and thus may maintain low steady voltages. Perfluorinated ion exchange material may serve additionally as a glue or binder for the fibrils. Generally, the diaphragm contains a major amount of the polyfluorocarbon fibrils, i.e., greater than 50 percent by weight of the fibrils. As perfluorinated ion exchange material is generally more costly than polyfluorocarbon fibrils, the diaphragm more preferably includes from about 65 to about 99 percent by weight polyfluorocarbon fibrils and from about 1 to about 35 percent by weight perfluorinated ion exchange material. Within such percentage ranges, the larger percentages of polyfluorocarbon fibrils are most preferred to minimize diaphragm cost, i.e., the diaphragm includes from about 95 to about 99 percent by weight polyfluorocarbon fibrils and from about 1 to about 5 percent perfluorinated ion exchange material wherein the perfluorinated ion exchange material provides the diaphragm with wettability.

Fibrillated polyfluorocarbon materials useful in this invention include, for example, polyvinylfluoride, polyvinylidene fluoride, polyperfluoro(ethylene-propylene), polytrifluoroethylene, poly(chlorotrifluoroethylene-ethylene), poly(tetrafluoroethylene-ethylene), polychlorotrifluoroethylene, and polytetrafluoroethylene. Preferably, the polyfluorocarbon is polytetrafluoroethylene (PTFE).

Fibrils of the polyfluorocarbon, e.g., polytetrafluoroethylene, can be prepared by slurrying polyfluorocarbon powder in a liquid medium, e.g., water or an alcohol such as isopropanol, and subjecting the slurry to a high speed mixing in a high shear commercial blender or mixer. When the fluorocarbon is fibrillated in an aqueous medium, a surfactant, e.g., a polyethoxylated aliphatic chloride of the formula $R(OR')_xCl$ as described further herein, or a MERPOL wetting agent, is preferably included in the liquid medium to help in the dispersion of the fibrils. For example, polytetrafluoroethylene fibrils can be prepared by slurrying polytetrafluoroethylene powder having an average particle size of less than about 500 microns in diameter (TEFLON® K, available from E. I. DuPont de Nemours and Co.) in isopropanol and mixing rapidly in a blender for a sufficient time to fibrillate the powder. After fibrillation, the resultant fibrils generally have dimensions as follows: length—about 100 microns to about 3000 microns; diameter—about 1 to about 150 microns; and average diameter—about 20 microns. The majority of fibrillated PTFE prepared by high speed mixing in, e.g., isopropanol, has diameters within the range of about 5 to about 50 microns. The size distribution of the fibrillated PTFE helps in packing the diaphragm during, e.g., vacuum depostion. Generally, the amounts of polyfluorocarbon powder, e.g., PTFE powder, to the liquid medium can vary from about 1 to about 40 percent by weight of powder, basis total weight of liquid and powder. Suitably, the polyfluorocarbon powder can be slurried in a liquid medium at the desired weight percent of solids in the slurry to be deposited upon the cathode, e.g., in an amount of from about 1 to about 10 percent by weight, and then fibrillated. Thereafter, the additional materials such as perfluorinated ion exchange material can be added to the slurry of fibrillated PTFE and the diaphragm deposited.

Polyfluorocarbon fibrils can also be prepared by milling a mixture of polyfluorocarbon powder and a fibril-inducing particulate, e.g., a solid granular inert material such as sodium chloride (salt), alumina, sand, limestone, or graphite. After the polyfluorocarbon powder and the particulate have been milled, the particulate is removed. For example, when salt is the particulate, the salt can be dissolved to leave the fibrillated polyfluorocarbon. U.S. Pat. No. 4,444,640 describes, at column 3, line 27 through column 4, line 25, milling particulate polytetrafluoroethylene with a fibril-inducing substrate under high shear forces to fibrillate polytetrafluoroethylene, and such description is hereby incorporated by reference. After fibrillation by milling, the resultant fibrils generally have dimensions as follows: length—about 1000 to 4000 microns; and diameter—generally about 20 to 600 microns with the majority about 75 to 250 microns.

Polyfluorocarbon fibrils may also be prepared from stretched or expanded polytetrafluoroethylene. Stretched or expanded polytetrafluoroethylene can be prepared, e.g., by stretching an unsintered shaped article of polytetrafluoroethylene, the shaped article having been formed by a paste-forming extrusion process. The stretching of the polytetrafluoroethylene article may be conducted between about 35° C. and about 400° C. a nd the article can be stretched generally from about 2 times to about 2000 times the original dimension of the article. Stretched or expanded polytetrafluoroethylene can also be prepared in accordance with U.S. Pat. No. 3,953,566, which describes stretching unsintered polytetrafluoroethylene at temperatures between about 35° C. and the crystalline melting point of the polymer and at stretching rates exceeding 10 percent per second. Such stretched unsintered polytetrafluoroethylene may subsequently be sintered by heating at temperatures between about the crystalline melting point of the polymer and 400° C. for about 10 to 30 minutes.

Stretched or expanded polyfluorocarbon material (for example, GORETEX joint sealant available from W. L. Gore & Associates) can be fibrillated by chopping pieces of such material with a lower alkanol, e.g., ethanol or isopropanol, or with water including a surfactant such as MERPOL wetting agent (from E. I. DuPont de Nemours & Co.) or a polyethoxylated aliphatic chloride of the formula $R(OR')_xCl$ as described herein, in a blender. Such fibrillated polyfluorocarbon, e.g., polytetrafluoroethylene can then be used to form the diaphragms of this invention.

Finally, suitable polyfluorocarbon fibrils may be prepared by mixing polyfluorocarbon powder under moderate to high shear conditions in the absence of any liquid medium or solid granular inert material. For example, polytetrafluoroethylene fibrils can be obtained by blending polytetrafluoroethylene powder in a mixer such as a Brabender mixer and such fibrils can then be used in forming a diaphragm.

Perfluorinated ion exchange material may be incorporated in the various embodiments of this invention in the form of, e.g., a solid, a gel or a solution. As a solid, for example, the perfluorinated ion exchange material can be added to the slurry as discrete particulates or fibers. As a solution, perfluorinated ion exchange material can be added to the slurry dissolved in any suitable solvent such as ethanol although rather than being dissolved the perfluorinated ion exchange method may be highly solvated particles. The solid perfluorinated ion exchange material may be, e.g., in the acid form of the perfluorinated ion exchange material and may be swollen with an organic liquid such as ethanol or isopropanol.

The perfluorinated ion exchange material is generally an organic copolymer formed from polymerization of a fluorovinylether monomer containing a functional group, i.e., an ion exchange group or a functional group easily converted into an exchange group, and a monomer chosen from the group of fluorovinyl compounds, e.g., vinyl fluoride, vinylidene fluoride, trifluoroethylene, tetrafluoroethylene, hexafluoropropylene, chlorotrifluoroethylene, and perfluoro(alkylvinylether) with the alkyl being a $C_1$–$C_{10}$ alkyl group. The functional groups are —COOM or —$SO_3M$ or may be —$PO(OM)_2$ or —$OPO(OM)_2$ where M is hydrogen or an alkali metal ion. Further, the functional groups may be precursors of the —COOM or —$SO_3M$ groups which can be converted to the carboxylic acid or sulfonic acid and salts thereof by hydrolysis.

The content of the fluorovinylether having the functional groups in the copolymer is important as it determines the ion exchange potential of the perfluorinated ion exchange material and thus, controls its hydrophilicity or wettability. The fluorovinyl ether content is generally in the range of about 1 to about 50 mole percent, preferably about 2 to about 40 mole percent. Generally, the equivalent weight of the perfluorinated ion exchange material will be from about 600 to 2000. Equivalent weight is the weight of material in grams which contains one equivalent of potential ion exchange capacity.

In one embodiment, polyfluorocarbon fibrils are coated with a solution of perfluorinated ion exchange material before slurrying. For example, polytetrafluoroethylene powder can be mixed with a solution of a perfluorinated ion exchange material in a powder to liquid weight ratio of about 3:2 to 10:1. Generally, such solutions may contain from about 5 to about 20 percent by weight of the perfluorinated ion exchange material. Preferably, the solvent is miscible with water. Mixing the PTFE powder and the solution of perfluorinated exchange material under high shear conditions such as those conditions in a Brabender mixer can result in the fibrillation of the polytetrafluoroethylene and coating of polytetrafluoroethylene fibrils with perfluorinated ion exchange material. The coated fibrillated material may lump together but can be dispersed in an aqueous medium by blending with sufficient water and preferably surfactant. Thereafter, such coated fibrils are deposited from the slurry. Coating polyfluorocarbon fibrils separate from the deposition stage may require less perfluorinated ion exchange material than the simultaneous deposition of polyfluorocarbon fibrils and either a solution or discrete particles of perfluorinated ion exchange material, yet still provide wettability to the fibrillated polyfluorocarbon.

In another embodiment, polyfluorocarbon fibrils may have perfluorinated ion exchange material incorporated therewith, e.g., though coating or admixture of the materials, by extruding the polyfluorocarbon material in admixture with a solution of perfluorinated ion exchange material. Also, a modified polyfluorocarbon, e.g., polytetrafluoroethylene, can be produced by copolymerizing tetrafluoroethylene and a perfluorinated monomer having an acid type functional group as described by U.S. Pat. No. 4,326,046. Such modified polyfluorocarbon may contain from about 0.01 to 10 weight percent of the perfluorinated monomer and such modified material may subsequently be fibrillated to provide depositable material for the present invention.

The perfluorinated ion exchange material can generally be from those materials presently supplied for use as electrolyte impermeable membranes in various electrolytic cells, in particular, the membrane materials known as Nafion®, available from E. I. DuPont de Nemours and Company and those known as Flemion®, available from Asahi Glass Company, Ltd.

In another embodiment, a diaphragm of the present invention can include fibrillated polyfluorocarbon, perfluorinated ion exchange material and a minor amount of chemically resistant inorganic particulates. By chemically resistant is meant that the particulates are substantially stable in an intended cell environment such as that within a chlor-alkali cell. The chemically resistant inorganic particulates are exemplified by zirconium oxide, titanium dioxide, potassium titanate, aluminum oxide, silicon carbide, talc, asbestos, barium sulfate and mixtures thereof. By inclusion of such chemically resistant inorganic particulates, the amount of polyfluorocarbon in the diaphragm may be reduced without diminishing the cell performance. Such diaphragms can generally contain from about 70 to about 95 percent by weight fibrillated polyfluorocarbon, e.g., PTFE, from about 1 to about 5 percent by weight of the perfluorinated ion exchange material, i.e., an amount sufficient to provide wettability, and a minor amount of the inorganic particulates, i.e., from about 1 to 25 percent by weight, more preferably from about 5 to 15 percent by weight inorganic particulates, basis total weight of diaphragm. The perfluorinated ion exchange material may be codeposited in the diaphragm as a solid, gel or solution to provide the diaphragm with wettability. Optionally, either or both the fibrillated polyfluorocarbon and the inorganic particulates can be coated with perfluorinated ion exchange material prior to deposition.

In any of the described embodiments of this invention, it may be desirable and even preferable that the diaphragm be asbestos-free. Also, it may be preferable to use unsintered polytetrafluoroethylene to obtain the fibrillated polyfluorocarbon. Such unsintered, fibrillated polytetrafluoroethylene may be preferred over fibrillated polytetrafluoroethylene that has been sintered at some stage prior to fibrillation.

The liquid permeability of the diaphragms is adjustable by the utilization of a pore forming material. For example, a pore forming material can be codeposited with polyfluorocarbon fibrils and perfluorinated ion exchange material. Such pore forming material is subsequently removable, e.g., by chemical leaching after deposition of the diaphragm, by heating to decomposition temperatures of the pore forming material following deposition of the diaphragm, or by removal in situ during subsequent operation of the cell via the chemical action of an electrolyte within the cell. Among suitable pore formers in the preparation of the diaphragms are cellulose, rayon, polypropylene, calcium carbonate, starch, polyethylene and nylon. Cellulose, rayon, polypropylene, polyethylene or nylon can be present in any suitable particulate form, e.g., granular or fibrous form. Preferably, the pore forming material is polyethylene or polypropylene and present in fibrous form. Most preferably, the pore forming material is polypropylene. Surprisingly, it has been found that dispersion of polytetrafluoroethylene fibrils in an aqueous medium is improved by the presence of discrete particulates of polypropylene. The amount of pore forming material codeposited with the other diaphragm materials will vary depending on the desired permeability of the diaphragm. Generally, the pore forming material can be added in an amount from about 1 to about 30 percent by weight, more preferably from about 1 to about 20 percent by weight, basis total weight of diaphragm materials, e.g., polyfluorocarbon fibrils, perfluorinated ion exchange material and inorganic particulates.

The diaphragms of this invention can also incorporate an inorganic gel. The inorganic gel may be a hydrous metal oxide gel such as magnesium oxide gel, zirconium oxide gel, or titanium oxide gel, a zirconyl phosphate gel, or combinations thereof. Such inorganic gels can serve to reduce the liquid permeability of a diaphragm to a desired level and may also provide ion exchange properties to the diaphragm. The inorganic gel can be added to the diaphragm after formation of the diaphragm. For example, after a diaphragm of fibrillated PTFE and perfluorinated ion exchange material is formed in situ upon a non-planar cathode, an inorganic gel can be added to the diaphragm matrix by filling the matrix with an inorganic gel precursor, i.e., a solution of an inorganic salt, e.g., zirconium oxychloride, titanium oxychloride, or magnesium chloride and thereafter, hydrolyzing the inorganic salt thereby providing a hydrous oxide of the zirconium, titanium or magnesium as the inorganic gel. Magnesium and zirconium inorganic gels can be prepared, e.g., in the manners described in U.S. Pat. Nos. 4,170,537, 4,170,538 and 4,170,539. A zirconyl phosphate gel can be formed by filling the diaphragm matrix with a solution of zirconium oxychloride and then contacting the matrix with a solution of dibasic sodium phosphate to precipitate zirconyl phosphate gel.

Precursors of such hydrous inorganic gels can be deposited in various ways. For example, a solution of the precursor can be brushed or sprayed onto the diaphragm matrix if the solution will penetrate or soak into the porous matrix. Otherwise, the diaphragm matrix can be immersed in the solution, a vacuum drawn to remove the air from the matrix and the vacuum released to draw the solution into the matrix.

Inorganic gels can also be incorporated in the diaphragm in situ during cell operation. For example, an inorganic salt such as magnesium chloride hexachloride or zirconium oxychloride can be added to anolyte, i.e., the brine feed, while the diaphragm is operated in a chlor-alkali cell whereby an inorganic gel can be formed within the diaphragm pores in situ. Mixtures of inorganic salts may be added. Preferably, the inorganic salts may be added to the anolyte immediately after cell startup, i.e., within the first few hours, more preferably, first few minutes, in the period before the hydroxide ions formed at the cathode have begun to migrate substantially through the diaphragm towards the anode.

The diaphragms of the present invention are prepared by depositing the diaphragm materials from a slurry onto a liquid permeable substrate, e.g., a foraminous cathode. The foraminous cathode is electroconductive and may be a perforated sheet, a perforated plate, metal mesh, expanded metal mesh, metal rods, or the like. For example, the openings in foraminous cathodes commercially used today in chlor-alkali cells are usually about 0.05 to about 0.125 inches in diameter. Most commonly the cathode will be of iron or an iron alloy. By iron alloy is meant a carbon steel or other alloy of iron. Alternatively, the cathode can be nickel or other cell environment resistant electroconductive material. Cathodes suitably used in this invention include those having an activated surface coating, for example, those cathodes with a porous Raney nickel surface coating. Raney nickel coatings can provide a reduction of hydrogen overvoltage at the cathode and allow a savings in energy consumption and cost in the electrolysis of brine. Raney nickel coatings can be provided by various expedients well known to those skilled in the art.

A slurry can be provided containing a liquid medium and the diaphragm materials. The liquid medium should be capable of dispersing and suspending the diaphragm materials such as fibrillated polytetrafluoroethylene, perfluorinated ion exchange material, e.g., particles or fibers of NAFION® or FLEMION®, pore forming materials such as cellulose or polypropylene, and inorganic particulates, e.g., titanium dioxide or zirconium oxide. The liquid medium can generally be selected from among water or nonaqueous liquids, e.g., $C_1$–$C_4$ alcohols such as methanol, ethanol, isopropanol, n-propanol, n-butanol, isobutanol or t-butanol, $C_1$–$C_4$ glycols such as ethylene glycol or propylene glycol, mono- or di-alkyl acetamides wherein the alkyl group contains from 1 to 4 carbon atoms such as dimethyl acetamide, diethyl acetamide, dibutyl acetamide, dipropyl acetamide, or butyl acetamide, dialkylformamides wherein the alkyl group contains from 1 to 4 carbon atoms such as dimethylformamide or dibutylformamide, N-methyl pyrrolidinone, dimethylsulfoxide, and propylene carbonate. Preferably, the liquid medium is water, propylene carbonate, ethylene glycol, dimethyl formamide, or dimethyl sulfoxide. An aqueous liquid medium is most preferred and can be an aqueous solution of sodium chloride, sodium hydroxide or mixtures thereof or may be the cell liquor from the electrolytic cells used in production of chlorine and sodium hydroxide or a synthetically produced cell liquor. Such cell liquor normally contains from about 50 to about 200 grams per liter sodium hydroxide and from about 150 to about 260 grams per liter sodium chloride.

An aqueous slurry may also contain a viscosity modifier or thickening agent to assist in the dispersion of the polyfluorocarbon fibrils. For example, one particularly suitable thickening agent or viscosity modifier is a hydrocarbon polymer of acrylamido-methylpropanesulfonic acid and having a molecular weight of about 1 million (RHEOTHIK®, a material available from Henkel Corp.). Generally from about 0.1 to about 5 percent by weight of the thickening agent may be added to the slurry mixture, basis total weight of slurry, more preferably from about 0.1 to about 2 percent by weight thickening agent.

The aqueous slurries used in preparation of the diaphragms can also contain a surfactant. A particular nonionic surfactant (a chloride of a polyethoxylated aliphatic alcohol) represented by the formula $R—OR')_xCl$, wherein R is selected from the group consisting of $C_1$–$C_{30}$ linear and branched alkyl, R' is the ethylene group represented by $—CH_2—CH(R'')—$ wherein R'' is selected from hydrogen, methyl, ethyl or mixtures thereof and x is a number from 5 to 15, has been found advantageous in obtaining a well dispersed aqueous slurry of polyfluorocarbon fibrils. X is not limited to integers from 5 to 15 as it represents the average number of ethylene groups per mole of the compound. Preferably, R is selected from the group of $C_8$–$C_{15}$ linear or branched alkyl, R' is ethylene, and x is 9 or 10. Most preferably, for wetting and dispersing a polyfluorocarbon, such as polytetrafluoroethylene, R is a mixture of $C_{12}$–$C_{15}$ linear alkyls, R' is ethylene and x is 9. Generally from about 0.1 to about 3 percent by weight of the nonionic surfactant can be added to the slurry mixture, basis total weight of slurry, more preferably from about 0.1 to about 1 percent by weight of the nonionic surfactant. Otherwise, a surfactant such as MERPOL wetting agent may be used. The aqueous slurry may also include an anti-foaming additive, e.g., 2-ethylhexanol.

The amount of suspended diaphragm materials, e.g., fibrillated polyfluorocarbon, in the slurry medium is generally in the range of about 0.2 to about 20 weight percent, more preferably from about 0.5 to about 10 weight percent, basis total weight of slurry. The diaphragm of this invention can be deposited from the slurry directly upon a substrate, for example, a cathode, by vacuum deposition, pressure deposition, electrophoresis or combinations of such deposition techniques.

The diaphragm materials can optionally be deposited onto a subsequently removable precoat layer upon the substrate. The precoat can be a layer of a material such as cellulose fibers which can be deposited from a cellulosic fiber slurry upon the substrate. Thereafter, the mesh or mat of cellulose fibers provides additional surface area and reduces the size of the substrate openings. Such a precoat may allow the diaphragm to be deposited with a more uniform distribution. Further, the precoat can serve as a filter and increase the deposition of diaphragm materials upon the substrate. The precoat is subsequently removable, e.g., by chemical leaching before gel addition or cell operation, or by chemical action of electrolyte within the cell during cell operation.

The diaphragms of this invention are generally deposited upon the foraminous cathode in an amount of about 0.1 to about 0.5 pounds per square foot diaphragm material more preferably about 0.25 to 0.35 pounds per square foot diaphragm material, i.e., polyfluorocarbon fibrils, perfluorinated ion exchange material, inorganic particulates and optionally, the pore former. The diaphragm will generally have a thickness of about 0.01 to 0.25 inches, preferably about 0.02 to 0.15 inches to achieve best results in terms of voltage and energy efficiency.

Following the deposition of the diaphragm material, the diaphragm is generally heated to dry and secure the diaphragm upon the cathode. The temperature at which the diaphragm is heated should not result in any significant decomposition of diaphragm material other than the pore forming agent and should not adversely affect the porosity and liquid permeability of the diaphragm. For example, heating a deposited diaphragm at temperatures above the sintering or melting temperatures of polyfluorocarbon fibrils can result in an impermeable diaphragm, i.e., a membrane, by the melting and flowing of the polyfluorocarbon. Although pore forming material can be included in the deposited diaphragm to retain liquid permeability upon such sintering or melting, the pore forming material may not provide the combination of porosity and tortuosity achieved by fibrillated polyfluorocarbon diaphragms prepared in accordance with the present process. Thus, in the preparation of a diaphragm including fibrillated polyfluorocarbon and perfluorinated ion exchange material, e.g., the deposited mat of polyfluorocarbon fibrils and perfluorinated ion exchange material, is heated at temperatures below the sintering or decomposition temperatures of the fibrillated polyfluorocarbon or ion exchange materials for a sufficient time to secure the diaphragm. Heating the diaphragm at temperatures below the sintering point can significantly reduce energy consumption. As the perfluorinated ion exchange materials may generally decompose at temperatures between about 250° C. and 300° C. the diaphragm is generally heated at temperatures from about 50° C. to about 225° C., preferably from about 90° C. to about 150° C. for about one hour.

In operation of chlor-alkali cells containing the deposited diaphragms of this invention, sodium chloride brine feed generally containing from about 290 to 330 grams per liter of sodium chloride will be fed to the anolyte compartment. Such a brine feed can have a quality similar to that used for asbestos-type diaphragm cells, i.e., the brine generally can contain about 2 to 3 parts per million alkaline earth metal ion impurities such as calcium and magnesium. In some instances, particularly in diaphragms containing more than about 10 to 20 percent by weight perfluorinated ion exchange material, it may be desirable to use higher quality brine, i.e., brine containing less than about 20 parts per billion alkaline earth metal impurities. Brine treatment methods capable of obtaining the desired quality levels are well known to the skilled in the art.

The present invention is more particularly described in the following Examples which are intended as illustrative only, since numerous modifications and variations will be apparent to those skilled in the art.

EXAMPLE 1

A mixture of 7.50 grams (g) Teflon K® (a particulate polytetrafluoroethylene available from E. I. DuPont de Nemours and Co.), 1.71 g cellulose filter paper, and 100 milliliters (ml) isopropanol was blended in a commercial blender for about four minutes to fibrillate the polytetrafluoroethylene particles and to chop and disperse the cellulose fibers. To this mixture was added 3.52 g of powdered perfluorinated ion exchange material having carboxylic acid groups (Flemion HB®, from Asahi Glass Company, Ltd.) in a solution containing 12.3 g propylene carbonate, 4.0 g viscosity modifier (RHEOTHIK® 80-11) and 80 g of isopropanol. The combined mixture was blended for two minutes to provide the slurry for diaphragm deposition.

The slurry was poured over a 3 inch by 3 inch perforated steel plate cathode covered with cellulose filter paper and a 25 inch mercury vacuum was applied to draw the slurry liquids through the cathode. The solids were filtered out as a mat atop the filter paper. The cathode and diaphragm mat were placed in an oven and dried at temperatures between 120° C. to 130° C. for 30 minutes with continued application of the vacuum.

After cooling, the cathode-diaphragm assembly was placed in a laboratory chlor-alkali cell having a ruthenium oxide/titanium oxide coated titanium mesh anode. The cell was operated with the anode against the surface of the diaphragm. The cell was fed a purified sodium chloride brine (25 weight percent NaCl) containing less than 20 parts per billion total of calcium and magnesium. The cell was operated at about 90° C. with a current density of 31 100 amperes per square foot (ASF). Over the first 75 days of operation the cell produced 11.1 weight percent sodium hydroxide at a cathode current efficiency of 95 percent and at 2.73 volts. No deterioration of cell performance or the diaphragm was observed over this period of time.

EXAMPLE 2

Polytetrafluoroethylene fibrils were prepared by blending TEFLON 60 powder and salt (−100 mesh) for about two minutes in a Brabender mixer at a PTFE:salt ratio of 1:24. The clumped salt-fiber mixture was then chopped in a blender and screened through a 30 mesh screen to separate most of the salt. The remaining fibers were washed with water to remove the remaining salt and dried.

A slurry containing 8.7 g of the PTFE fibrils, 0.96 g melt-blown polypropylene fibers (POLYWEB polypropylene), 1.35 g of an ethanol solution of a perfluorinated ion exchange material having sulfonic acid functional groups (NAFION 601 solution), the solution including 8.3 weight percent of the ion exchange material, 4.0 g RHEOTHIK 80-11 viscosity modifier, and 4.0 g of a non-ionic surfactant (a polyethoxylated aliphatic chloride, i.e., $C_{10}$ $-C_{15}(OCH_2CH_2)_9Cl$ was blended in about 190 ml of water. The slurry was deposited onto a cathode and dried as in Example 1. The deposited diaphragm had a weight of 0.25 pounds per square foot of cathode area. The diaphragm-cathode assembly was placed into a laboratory cell operated as in Example 1. After two days, the cell voltage was 2.63 volts and the cell was producing 9.8 weight percent sodium hydroxide at a cathode current efficiency of 88 percent and a 1.5 inch differential level between anolyte and catholyte.

COMPARATIVE EXAMPLE 1

A diaphragm was formed from polytetrafluoroethylene fibrils without inclusion of perfluorinated ion exchange material as follows. A slurry containing 9.6 g of PTFE fibrils prepared as in Example 2, 4.2 g RHEOTHIK 80-11 viscosity modifier, and 4.2 g of the polyethoxylated aliphatic chloride surfactant described in Example 3 was blended with about 210 g of water. The slurry was allowed to stand for two hours, then was agitated, followed by deposition and drying as in Example 1. The diaphragm weight was 0.25 pounds per square foot cathode area. The diaphragm-cathode assembly was placed into a laboratory cell and operated as in Example 1.

Cell voltage reached a minimum value of 2.89 volts after about 0.5 hour of operation. Within an hour the voltage had increased to 3.10 volts and at 4.5 hours of operation voltage had reached 3.52 volts. During this time period hydrogen content in the chlorine had increased to levels over 25 percent and the cell operation was stopped.

A comparison of the diaphragms in Examples 1–2 with Comparative Example 1 demonstrates the reduced cell voltages achievable under similar cell conditions by the present invention. Examples 1–2 show steady cell voltages of less than about 2.85 volts whereas Comparative Example 1 had a rapid increase in cell voltage to over 3.5 volts after a few hours of operation.

Although the present invention has been described with reference to specific details, it is not intended that such details should be regarded as limitations upon the scope of the invention, except as and to the extent they are included in the accompanying claims.

What is claimed is:

1. A liquid permeable, diaphragm for an electrolytic cell, said diaphragm comprised of from about 65 to 99 percent by weight fibrillated polyfluorocarbon and from 1 to about 35 percent by weight perfluorinated ion exchange material, basis total weight of polyfluorocarbon and ion exchange material, said diaphragm prepared by depositing polyfluorocarbon fibrils and perfluorinated ion exchange material from a slurry onto a foraminous cathode whereby to form an entangled mat and heating the deposited mat at temperatures below the sintering or decomposition temperatures of both the polyfluorocarbon fibrils and the perfluorinated ion exchange material for a sufficient time to secure the mat upon the cathode.

2. The diaphragm of claim 1 wherein the perfluorinated ion exchange material is a perfluorinated organic polymer having ion exchange functional groups selected from the group consisting of —COOM and —$SO_3M$ where M is hydrogen or an alkali metal ion.

3. The diaphragm of claim 1 wherein the polyfluorocarbon comprises polytetrafluoroethylene.

4. The diaphragm of claim 2 wherein the polyfluorocarbon comprises polytetrafluoroethylene.

5. The diaphragm of claim 3 wherein fibrillated polytetrafluoroethylene is coated with a perfluorinated organic polymer containing ion exchange functional groups selected from the group consisting of —COOM and —$SO_3M$ where M is hydrogen or an alkali metal ion.

6. The diaphragm of claim 4 wherein perfluorinated ion exchange material is in the form of particulates.

7. The diaphragm of claim 4 wherein a pore forming material selected from the group consisting of cellulose, rayon, polypropylene, polyethylene, nylon or starch is codeposited from the slurry onto the foraminous cathode.

8. The diaphragm of claim 5 wherein a pore forming material selected from the group consisting of cellulose, rayon, polypropylene, polyethylene, nylon or starch is codeposited from the slurry onto the foraminous cathode.

9. The diaphragm of claim 4 further including a minor amount of inorganic particulates selected from the group consisting of titanium dioxide, zirconium oxide, potassium titanate, aluminum oxide, barium sulfate, silicon carbide, asbestos or talc.

10. The diaphragm of claim 4 further including a minor amount of inorganic particluates selected from the group consisting of titanium dioxide, zirconium oxide, potassium titanate, aluminum oxide, barium sulfate, silicon carbide, asbestos or talc codeposited from the slurry onto the foraminous cathode.

11. The diaphragm of claim 10 wherein inorganic particulates are coated with the perfluorinated organic polymer having ion exchange functional groups selected from the group consisting of —COOM and —$SO_3M$ where M is hydrogen or an alkali metal ion.

12. The diaphragm of claim 11 wherein fibrillated polytetrafluoroethylene is coated with a perfluorinated organic polymer containing ion exchange functional groups selected from the group consisting of —COOM and —$SO_3M$ where M is hydrogen or an alkali metal ion.

13. The diaphragm of claim 10 wherein a pore forming material selected from the group consisting of cellulose, rayon, polypropylene, polyethylene, nylon or starch is codeposited from the slurry onto the foraminous cathode.

14. The diaphram of claim 4 wherein the diaphragm is asbestos-free.

15. The diaphragm of claim 7 further including an inorganic gel selected from the group consisting of hydrous magnesium oxide gel, hydrous zirconium oxide gel, hydrous titanium oxide gel, zirconyl phosphate gel, or ferric hydroxide gel.

16. A process of preparing a liquid permeable diaphragm comprising:

(a) providing a slurry including a liquid medium, polyfluorocarbon fibrils and perfluorinated ion exchange material;

(b) depositing the polyfluorocarbon fibrils and perfluorinated ion exchange material from said slurry onto a foraminous cathode whereby to form a diaphragm; and (c) heating the deposited diaphragm at temperatures below the sintering or decomposition temperatures of both the polyfluorocarbon fibrils and the perfluorinated ion exchange material for a sufficient time to secure the diaphragm upon the cathode.

17. The process of claim 16 wherein the polyfluorocarbon fibrils are polytetrafluoroethylene fibrils and the perfluorinated ion exchange material is a perfluorinated organic polymer having ion exchange functional groups selected from the group consisting of —COOM, and —$SO_3M$ where M is hydrogen or an alkali metal ion.

18. The process of claim 17 wherein the slurry further includes a pore forming material selected from the group consisting of cellulose, rayon, polypropylene, polyethylene, nylon or starch and the pore forming material is codeposited from the slurry upon the cathode with the polyfluorocarbon fibrils and the perfluorinated ion exchange material.

19. The process of claim 17 wherein the liquid medium is selected from the group of water, isopropanol, ethanol, dimethyl sulfoxide, propylene carbonate, ethylene glycol, an aqueous sodium chloride solution, an aqueous sodium hydroxide solution or mixtures thereof.

20. The process of claim 17 wherein the liquid medium is water and the slurry further includes a viscosity modifier and a surfactant capable of dispersing the polyfluorocarbon fibrils.

21. The process of claim 18 wherein the liquid medium is water and the slurry further includes a viscosity modifier and a surfactant capable of dispersing the polyfluorocarbon fibrils.

22. The process of claim 17 wherein the slurry further includes inorganic particulates selected from the group consisting of titanium dioxide, zirconium oxide, potassium titanate, silicon carbide, aluminum oxide, barium sulfate, asbestos or talc.

23. The process of claim 22 wherein inorganic particulates are precoated with the perfluorinated ion exchange material.

24. The process of claim 18 wherein the slurry further includes inorganic particulates selected from the group consisting of titanium dioxide, zirconium oxide, potassium titanate, silicon carbide, aluminum oxide, barium sulfate, asbestos or talc.

25. The process of claim 24 wherein inorganic particulates are precoated with the perfluorinated ion exchange material.

26. The process of claim 17 wherein an inorganic gel selected from the group consisting of hydrous magnesium oxide gel, hydrous zirconium oxide gel, zirconyl phosphate gel, hydrous titanium oxide gel, or ferric hydroxide gel is precipitated within the deposited diaphragm.

27. The process of claim 26 wherein the inorganic gel is precipitated in situ within the deposited diaphragm during cell operation.

28. The process of claim 18 wherein an inorganic gel selected from the group consisting of hydrous magnesium oxide gel, hydrous zirconium oxide gel, zirconyl phosphate gel, hydrous titanium oxide gel, or ferric hydroxide gel is precipitated within the deposited diaphragm.

29. The process of claim 28 wherein the inorganic gel is precipitated in situ within the deposited diaphragm during cell operation.

30. The process of claim 20 wherein the surfactant is a non-ionic surfactant represented by the formula $R(OR')_xCl$ wherein R is a $C_8$–$C_{15}$ linear or branched alkyl, R′ is an ethylene group represented by —$CH_2$—CH(R″)— wherein R″ is hydrogen, methyl, ethyl or mixtures thereof and x is a number from 8 to 12.

31. The process of claim 21 wherein the surfactant is a non-ionic surfactant represented by the formula $R(OR')_xCl$ wherein R is a $C_8$–$C_{15}$ linear or branched alkyl, R′ is an ethylene group represented by —$CH_2$—CH(R″)— wherein R″ is hydrogen, methyl, ethyl or mixtures thereof and x is a number from 8 to 12.

32. In a process of electrolyzing alkali metal chloride in an electrolytic cell including a liquid permeable diaphragm, the improvement which comprises utilizing a diaphragm comprising from about 65 to 99 weight percent fibrillated polytetrafluoroethylene and from about 1 to about 35 weight percent perfluorinated organic polymer having ion exchange groups selected from the group consisting of —COOM or —$SO_3M$ where M is hydrogen or an alkali metal ion, basis total weight of polytetrafluoroethylene and perfluorinated organic polymer.

33. The process of claim 32 wherein the diaphragm includes a pore forming material selected from the group consisting of cellulose, rayon, polypropylene, polyethylene, nylon or starch and the liquid permeability of the diaphragm is increased by the in situ removal of the pore forming material during cell operation.

34. The process of claim 32 wherein the liquid permeability of the diaphragm is reduced by the formation of an inorganic gel in situ within the diaphragm, the gel selected from the group consisting of hydrous magnesium oxide gel, hydrous zirconia oxide gel, hydrous titanium oxide gel, zirconyl phosphate gel or ferric hydroxide gel.

35. The process of claim 32 wherein the slurry further includes inorganic particulates selected from the group consisting of titanium dioxide, zirconium oxide, potassium titanate, silicon carbide, aluminum oxide, barium sulfate, asbestos or talc.

36. The process of claim 35 wherein inorganic particulates are coated with the perfluorinated organic polymer having ion exchange functional groups selected from the group consisting of —COOM and —$SO_3M$ where M is hydrogen or an alkali metal ion.

37. The process of claim 36 wherein fibrillated polytetrafluoroethylene is coated with a perfluorinated organic polymer containing ion exchange functional groups selected from the group consisting of —COOM and —$SO_3M$ where M is hydrogen or an alkali metal ion.

38. The process of claim 32 wherein fibrillated polytetrafluoroethylene is coated with a perfluorinated organic polymer containing ion exchange functional groups selected from the group consisting of —COOM and —$SO_3M$ where M is hydrogen or an alkali metal ion.

39. In a process of dispersing polyfluorocarbon particulates in an aqueous medium, the improvement which comprises utilizing a non-ionic surfactant represented by the formula $R(OR')_xCl$ wherein R is a $C_8$–$C_{15}$ linear or branched alkyl, R′ is an ethylene group represented by —$CH_2$—CH(R″)— wherein R″ is hydrogen, methyl, ethyl or mixtures thereof and x is a number from 8 to 12.

40. The process of claim 39 wherein the polyfluorocarbon particulates are polytetrafluoroethylene.

41. The process of claim 40 wherein R is a mixture of $C_{12}$–$C_{15}$ linear alkyls, R″ is hydrogen, and x is 9.

* * * * *